United States Patent [19]

Kober et al.

[11] Patent Number: 4,514,256

[45] Date of Patent: Apr. 30, 1985

[54] METHOD OF MINIMIZING SLAGGING IN THE BURNING OF BLACK LIQUID

[76] Inventors: Alfred E. Kober, 81 Claire Dr., Bridgewater, N.J. 08807; Stanley E. Gilewicz, 44 Center Grove Rd., Randolph, N.J. 07869

[21] Appl. No.: 485,750

[22] Filed: Apr. 18, 1983

[51] Int. Cl.[3] ..... D21C 11/12; C10L 10/00; F23J 1/00

[52] U.S. Cl. ..... 162/30.11; 110/343; 110/346; 162/48; 44/5

[58] Field of Search ..... 44/4, 5; 110/342, 343, 110/346; 431/4; 162/30.1, 30.11, 32, 36, 48

[56] References Cited

U.S. PATENT DOCUMENTS

| | | | |
|---|---|---|---|
| 3,332,755 | 7/1967 | Kukin | 44/4 |
| 3,547,605 | 12/1970 | Cornelius et al. | 44/4 |
| 3,692,503 | 9/1972 | Kukin | 44/4 |
| 3,713,792 | 1/1973 | Wiley | 44/4 |
| 3,800,466 | 4/1974 | Heit | 44/4 |
| 3,837,820 | 9/1974 | Kukin | 44/5 |
| 4,000,264 | 12/1976 | Nigano et al. | 162/30.11 |
| 4,047,875 | 9/1977 | May et al. | 44/4 |
| 4,159,683 | 7/1979 | Hughes et al. | 44/4 |

FOREIGN PATENT DOCUMENTS

| | | | |
|---|---|---|---|
| 2832596 | 1/1979 | Fed. Rep. of Germany | 162/48 |

*Primary Examiner*—William F. Smith
*Assistant Examiner*—K. M. Hastings
*Attorney, Agent, or Firm*—James & Franklin

[57] ABSTRACT

The formation of slag is minimized and the removability of slag is greatly increased, in connection with the furnace burning of black liquor, by applying to the surfaces where slag tends to form a substance which, under black liquor furnace conditions, reacts with the sodium sulfide content of the black liquor ash to oxidize said sodium sulfide and to be itself reduced, such substances preferably comprising sodium persulfate, manganese dioxide, cupric oxide and ferric oxide and mixtures thereof.

30 Claims, No Drawings

METHOD OF MINIMIZING SLAGGING IN THE BURNING OF BLACK LIQUID

BACKGROUND OF THE INVENTION

This invention relates to a method for improving the furnace-burning of black liquor produced in pulp making processes, and in particular to greatly reducing the deleterious effect of slag formation in black liquor furnaces by minimizing the amount of slag that is formed and particularly by making the slag much more easily removable and, in some instances, virtually self-removing.

There are three major pulping processes for the production of pulp. These are sulfate (kraft) process, the sulfite (Sivola) process, and the soda process. In the United States approximately 70 percent of the pulp produced is by the sulfate process, 25% by the sulfite process, and 5% by the soda process. As is known in the art, processes may be accomplished on a somewhat different basis than for the sulfite process. Aside from these considerations, however, the three major pulping processes all employ similar basic steps with chemical recovery, recycling, and combustion of the spent liquors, the chemical recovery being a very important economic part of each process.

In making pulp, wood in chip form or other cellulose material is processed in large digester-cookers which hold up to 50 tons or more of such wood chips. Alkaline compounds such as sodium sulfide and caustic soda are introduced into the digester-cookers together with steam under high pressure. The mixture of wood chips and alkaline digestion solution is cooked under high temperatures for 3 to 4 hours to separate the cellulose from the lignin, sugars and other non-cellulose substances in the wood. After this period of cooking or digestion, the wet cellulose fibers are separated from the digestion solution for further processing in the paper making process. At this point the digestion solution is spent liquor. The lignin and other organic compounds contained in the liquor are dark in color and hence the spent liquor is commonly called "black liquor." The black liquor constituents are used to generate heat. The inorganic substances in the liquor are recovered as molten ash or smelt, the smelt being tapped from the furnace and dissolved in the dissolving tank to form "green liquor." The green liquor is causticized with lime ($Ca(OH)_2$) to convert sodium carbonate to sodium hydroxide while the sodium sulfide remains unchanged. The "white liquor" thus attained is now ready for reuse in the digester. The calcium carbonate sludge precipitating from the white liquor is burned to lime in a kiln and can be used to causticize the green liquor to white liquor again, completing the cycle.

The smelt flowing from the smelt hearth into the dissolving tank consists mainly of sodium carbonate ($Na_2CO_3$) and sodium sulfide ($Na_2S$), with smaller amounts of sodium sulfate ($Na_2SO_4$) and caustic (NaOH).

To recover the digesting chemicals and to utilize the lignin and other residuals of black liquor, it is subjected to the following recovery process. The black liquor is concentrated by evaporation from about 15% solids (weak liquor) up to about 65% solids (heavy liquor). As the black liquor becomes more and more concentrated, its high viscosity requires that the black liquor be heated so that it will flow more readily through the pipes, valves, pumps and nozzles without plugging and deposition of solids. The chemical treatment of various types of wood results in black liquors of varying solid content and viscosities and it is advantageous to concentrate the liquors to as high a solid content as possible without precipitation or deposition in the recovery cycle.

The concentrated black liquor then is pumped to the mixing tank where sodium sulfate (salt cake) is added to the liquor to make up for the chemicals lost in the pulping cycle. Salt cake from the boiler hoppers and precipitators is likewise returned to the cycle.

The concentrated black liquor is then burned in a large recovery furnace. The lignin, sugars and other organic substances support combustion, and the inorganic chemicals from the digester are recovered from the furnace as molten ash or smelt. Black liquor combustion thus furnishes an auxiliary source of steam for the pulp making process.

In the recovery furnace the black liquor is sprayed into the combustion zone for burning. Some black liquor, when sprayed into the combustion chamber, burns in suspension; most is deposited on furnace walls where it dries and burns and drops as char to the smelt hearth. Here the final combustion and reduction of sodium sulfate to sodium sulfide takes place. It frequently happens that the furnace gas velocities are so strong that black liquor, unburned, is sucked upwards towards the superheat area where the molten inorganic constituents form pernicious deposits, frequently plugging air passages. When not enough heat is generated when burning black liquor the char at the smelt floor may become gummy and stop burning, forming so-called "jelly rolls," causing trouble in the reduction of the sodium sulfate to sodium sulfide, besides interfering with proper burning operations. Because of the high viscosity of the black liquor, even at elevated temperatures, the concentrated liquor ignites and burns slowly, and unburned black liquor is deposited on the interior surfaces of the furnace, and particularly on the steam boiler tubes. The deposition of unburned black liquor on the furnace interior and boiler tubes causes several problems. Slag deposits formed on the boiler tubes interfere with heat transfer and substantially reduce the efficiency of the recovery furnace. Such unburned black liquor and slag deposits, if permitted to remain on the boiler tubes, plug up the furnace and must be removed manually at considerable expense.

Buildup of slag is a major problem in the operation of black liquor furnaces. Black liquor throughout is decreased, steam production is reduced because slag deposits plug the gas passages, steam temperature is reduced because of heat loss due to slag on the tubes, and a substantial proportion of the steam produced must be used for slag-removal procedures and hence is wasted from a productivity point of view. When slag builds up to such an extent that the proper function of the furnace is seriously affected, the furnace must be shut down and the slag removed. In some installations the generating section is shut down and cleaned for this purpose every three months. Every shut down means a loss of a substantial number of man hours of productive operation, and in one commercial installation each shut down represents the equivalent of a loss of more than 2,000 tons of paper production.

In the past, slag has been removed by hand lancing and/or soot blowers. These practices require a substantial amount of man power, which itself adds to the economic loss involved, and consume very substantial amounts of steam and water. For example, in one installation the soot blowing operation calls for from 35,000 to 40,000 pounds of steam per hour, and the water used for washing down the furnace surfaces is treated water heated to approximately 290° F. at 300 psi and used at the rate of approximately 50,000 gallons an hour for five hours for each wash-down operation.

These extremely significant expenditures of man hours, steam and water have been necessary in the past because the slag that formed on the surfaces of black liquor furnaces was extremely tough and tenacious, being very hard to break up and, even when broken up, hard to dislodge from the furnace surfaces. Moreover, some of the furnace surfaces most severely subject to slag buildup are the outer surfaces of the boiler tubes, and the application of the force necessary to remove the slag from those tubes made boiler tube fracture, with the attendant dangers of explosion, quite possible.

In the past it has been proposed that slurries of various substances, such as magnesium oxides, be applied to the boiler tubes and other affected furnace surfaces to aid in separating the black liquor slag deposits therefrom. There slurries had only a physical effect on the slag and not a chemical effect, and they proved to be substantially ineffective. Even when they were used, systematic spraying and substantial soot blower operations were required in order to remove the deposits.

In a co-pending patent application entitled "Method Of Minimizing Slagging In The Burning Of Black Liquor", Ser. No. 164,368, filed June 30, 1980, now abandoned, and assigned to the assignees of this application, the wholly empirical discovery was disclosed and claimed that slag formation problems in black liquor were minimized by applying alumina to the surfaces where slag tends to form. The reason why alumina acted in that fashion was not understood. It was hypothesized that the alumina entered into chemical reaction with sodium compounds in the black liquor ash to form a high-melting, essentially non-slagging material—sodium meta aluminate—which itself was primarily responsible for an increase in slag melting temperature which in turn ameliorated slag buildup. This reaction was thought to have taken place with the sodium sulfate content of the black liquor ash. There were also those who theorized that alumina worked in this regard because it was in fact unreactive and controlled slag formation by its unique physical properties.

It has been discovered that these theories as to the reason why alumina was effective in this regard were incorrect, and with the discovery of what appears to be the true reason why alumina was effective in this regard it became apparent that certain other substances would also be similarly effective. Experimentation with those other substances suggested by this combination of theory and experimentation shows that they do indeed function well, and indeed even better than alumina, in reducing black liquor slag problems. When experiments revealed that there was apparently little or no chemical reaction between alumina and sodium sulfate, thus indicating that the original theory for the effect of alumina on black liquor slag was erroneous, experiments were continued to determine with what black liquor ash substances alumina did react, and it was discovered that significant reactions occurred between alumina on the one hand and sodium carbonate and sodium sulfide on the other hand, with sodium sulfide being particularly reactant. We then analyzed the effects of sodium sulfide and sodium carbonate on the melting point of black liquor boiler slag. It was discovered that in the absence of sodium sulfide the slag melting point temperature was inversely proportional to the sodium carbonate content, but when a low level of sodium sulfide was also present a dramatic decrease in slag melting point temperature was noted when compared with the situation when the sodium sulfide was not present. Since the low melting point for slag tends to increase the likelihood of slag buildup, it appeared that elimination or minimization of the sodium carbonate and sodium sulfide contents of the black liquor ash, and particularly the sodium sulfide content, would result in minimizing slagging tendencies.

An analysis of the reactions involved led to the conclusion that the characteristic of alumina which caused it to be so beneficial in connection with black liquor slagging was its atmospheric nature, and in particular the fact that is was reacting with the sodium sulfide and removing that sodium sulfide from the black liquor ash. We therefore concluded that since the removal of sodium sulfide from the black liquor ash appeared to be the key to slag amelioration, another way to accomplish the same result would be to oxidize the sodium sulfide, preferably to sodium sulfate, because sodium sulfate, as has been seen, is a normal constituent of black liquor ash and one which does not significantly enhance slag buildup. There are many substances which can act as strong oxidizing agents with respect to sodium sulfide, but not all such substances would be equally effective, since the reaction product of the oxidizer itself may act as a flux for the slag, reducing its melting point and thus tending to increase slag buildup. With that in mind, sodium persulfate has been found to be particularly suitable, probably because its decomposition product, sodium sulfate, is a normal component of recovery boiler ash. We have also found that manganese dioxide, cupric oxide and ferric oxide are effective slag-buildup-reducing oxidizers for sodium sulfide.

Thus investigation of the reason why empirically discovered alumina was effective gave rise to a new realization as to what it was in black liquor ash that most greatly contributed to its slagging tendency, and the further realization that certain substances theretofore unknown as black liquor slagging preventatives would indeed function effectively in that manner.

The prime object of the present invention is to provide a method which will substantially eliminate slag-formation problems in black liquor furnaces.

Another object of the present invention is to provide a method which, without interfering with the normal operation of the black liquor furnace, will minimize the formation of slag on the internal surfaces of the black liquor furnace, and in particular will cause slag to form which is very readily removed from those surfaces.

A further object of the present invention is to provide a method which, in a black liquor furnace, will produce a chemical reaction with the slag-forming components so as to produce a slag which is highly friable and extremely nontenacious with respect to the furnace surfaces.

It is yet another object of the present invention to provide a method for the operation of a black liquor furnace which, by the addition of a relatively inexpensive additive substance, will permit the continuous operation of the black liquor furnace for extremely long periods of time without shut-down and which will optimize the efficiency of operation of those furnaces during that period of time.

It is a more specific object of the present invention to provide a method which, in a black liquor furnace, is specifically directed to the chemical transformation of the sodium sulfide constituent of black liquor ash, thereby significantly raising the melting temperature slag and thus minimizing slag buildup in the furnace.

To these ends, we have discovered that if the slag, as it forms, is subjected to the action of the substance which, under black liquor furnace conditions, reacts with the sodium sulfide content of the black liquor ash to oxidize said sodium sulfide and to be itself reduced, of which general category sodium persulfate, manganese dioxide, cupric oxide, ferric oxide and mixtures thereof have been found to be particularly effective, that slag is readily broken up and separated from the furnace surfaces. This is accomplished by injecting one or more of those substances into the furnace, preferably in finely powdered form, as the black liquor is burned so that the substance is deposited on the furnace surfaces along with the slag-forming constituents. Preferably a thin coating of said substance is applied to the furnace surfaces before the burning of black liquor commences. While slag forms when the method of the instant invention is carried out, that slag is significantly different from the slag that had formed in the past in black liquor furnaces in that the slag forming in the course of carrying out the method of the present invention is very readily removed from the furnace surfaces and very readily broken up, so much so that steam temperature variations attendant upon normal operation of the furnaces at varying degrees of output are effective to cause the slag to break off from the furnace surfaces and fall to the bottom of the furnace without requiring any special slag-removing operations other than normal sootblowing.

The substance is preferably applied to the furnace surfaces on which slag tends to form by being introduced into the furnace upstream of those surfaces and blown onto those surfaces. To that end the substance is preferably in the form of finely divided particles so that it may be thus injected and blown. There is nothing critical, so far as is known, with respect to the size of the particles, but it is thought that in general the smaller the particles the better: good success has been attained when the substance is present in the form of particles 90% of which will pass through a #325 mesh screen. The substance is preferably introduced into the furnace in the form of dry particles, but it could also be thus introduced in the form of a slurry if desired.

As has been noted, the reaction of the oxidizing substances here disclosed and claimed with the sodium sulfide and sodium carbonate constituents of the black liquor ash, and particularly the sodium sulfide component thereof, produces compounds which themselves have high melting points, and that effect, coupled with the attendant reduction in the sodium carbonate and particularly the sodium sulfide content of the slag, gives rise to a slag having a melting point significantly higher than normal, it being borne in mind, as pointed out above, that the presence of sodium carbonate and particularly of sodium sulfide together with sodium carbonate in the slag tends to produce a comparatively low melting point, a characteristic which facilitates slag buildup.

Our research to determine the nature of the alumina-black liquor ash reaction was by no means cut and tried. We first tried to react alumina with sodium sulfate by heating a sodium sulfate-alumina mixture to a high temperature and then providing adequate drainage so that only alumina and reacted sodium would remain. This approach did not work. We then carried out the reaction at high temperature with the reaction product then mixed in water, after which the water was subjected to an atomic absorption test to see if it contained any soluble aluminum component. The reaction with sodium sulfate showed no such soluble aluminum, thus indicating that, contrary to what was originally thought, alumina and sodium sulfate did not react. Similar atomic absorption tests for the results of reaction between alumina and sodium carbonate and sodium sulfide showed significant amounts of soluble aluminum in the water, particularly when sodium sulfide was one of the initial reactants. It was this series of experiments which suggested to us that, contrary to previous thoughts, sodium sulfide was the major villain in connection with black liquor slagging. This hypothesis was confirmed by observing the melting points first of a two component system consisting of sodium sulfate and sodium carbonate and then a three component system consisting of sodium sulfate, sodium carbonate and sodium sulfide. The tests with the two component system showed that sodium carbonate concentration was inversely proportional to the slag melting point temperature, but there was a much more dramatic decrease in melting point when sodium sulfide was present in addition.

Next we conducted X-ray diffraction tests which showed that alumina and sodium sulfide and alumina and sodium carbonate both formed sodium aluminate, a high melting point substance, these X-ray diffraction tests confirming that mixtures of sodium sulfate and alumina did not produce sodium aluminate.

The following melting point tests of black liquor slag containing the additive substances here under discussion confirmed that the melting points of the slag were very considerably increased. Sodium persulfate present in an amount of 5% by weight, when tested with a synthetic slag, increased the melting point of the slag by 30° F, the same effect that 20% by weight of alumina produced. 20% by weight of manganese dioxide increased the synthetic slag melting point by 40° F. Tests were also performed on actual slag obtained from a commercial black liquor furnace. The observations made with synthetic slag were in general confirmed in the genuine slag tests, although in the genuine slag tests the observed melting point changes produced by sodium persulfate and manganese dioxide, while commercially significant, was somewhat less than those produced by alumina.

When sodium sulfide was reacted with manganese dioxide X-ray diffraction showed the presence of sodium sulfate and MnO. A reaction between sodium sulfide and CuO showed the production of sodium sulfate and $Cu_2O$.

Melting point tests on a synthetic slag (65.7% $Na_2SO_4$, 32.3% $Na_2CO_3$ and 2.0% $Na_2S$, mixed with starch, glycol and test materials to make fusion cones) gave the following results:

TABLE I

| Sample | Melting Point (°F.) |
|---|---|
| 100% Synthetic Slag (S.S.) | 1550 |
| 80% S.S./20% $MnO_2$ | 1590 |
| 95% S.S./5% $Na_2S_2O_8$ | 1580 |
| 80% S.S./20% $Al_2O_3$ | 1580 |

Similar melting point tests using actual black liquor slag were as follows:

TABLE II

| Sample | Melting Point (°F.) |
|---|---|
| 100% Genuine Slag | 1510 |
| 80% Genuine Slag/20% $MnO_2$ | 1550 |
| 90% Genuine Slag/10% $Na_2S_2O_8$ | 1530 |
| 80% Genuine Slag/20% $Al_2O_3$ | 1560 |

Further tests were made of synthetic slag of the composition set forth above with additives, in the proportions set forth below. A small 3/16 inch diameter pellet, consisting of a mixture of synthetic slag and test material, was placed on a mild steel coupon and then placed in a muffle furnace at 1500° F. for two minutes. The coupon was then removed and evaluated for corrosion, slag flow and structural integrity of the pellet. The coupons were given the following numerical ratings:

(1) Excellent—No corrosion, no slag flow, pellet structure remains intact or powders.
(2) Good—No corrosion, slight slag flow, pellet structure remains intact.
(3) Fair—Some corrosion, significant slag flow, small portions of structure remaining.
(4) Poor—Massive corrosion, gross slag flow, no pellet structure remaining.

Summary Table - Black Liquor Slag Modifiers

| Additive | Slag Test at Conc. of" 5% | 10% | 15% | 20% | 30% | X-Ray Diffraction | MP at 20% Level |
|---|---|---|---|---|---|---|---|
| None | Syn. Slag Rating | | | | 4 | — | Syn. Slag 1550° F. |
| $Al_2O_3$ | | 3 | | 2 | 1 | $NaAlO_2$ | 1580° F. |
| Sodium Persulfate | 3 | 2 | 2 | | | — | 1580° F. (5%) |
| $MnO_2$ | 3 | 2 | 1 | | | MnO | 1590° F. |
| $Fe_2O_3$ | 4 | 3 | 2 | | | $Fe_3O_4$ | |

It has been found that the method here disclosed gives best results when the furnace surfaces in question are substantially free of slag at the outset of the operation. Accordingly, in practicing the present invention it is highly desirable that the furnace be shut down and the furnace surfaces be cleaned before the method of the present invention is put into effect. It has further been found highly desirable that the substance be applied to the clean furnace surfaces in question before black liquor burning starts as well as while black liquor burning takes place. In this way the furnace surfaces in question are coated with the substance before slag starts to form. It is believed that this plays an important part in rendering the slag very non-tenacious with respect to the furnace surfaces. However, introduction of the substance while black liquor burning takes place is also required.

Simply as a matter of convenience, it is preferred to inject the finely divided substance into the black liquor furnace closely upstream of the slag-forming ares, where the temperature in the furnace is relatively low—approximately 1200°-1500° F.—but if desired, the substance, because of its chemical inertness (except to the sodium sulfide component of the black liquor ash), could be injected at other furnace locations where the temperatures are considerably higher.

Optimum results are achieved if the rate of application of the substance during the burning of the black liquor is varied, a relatively high rate of application existing during the initial burning stages—say the first two hours thereof—with the rate of application of substance thereafter being significantly reduced, either in one or a plurality of stages. Perhaps it is important, in order to produce the desired low tenacity of the slag deposits, to cause that portion of the slag closest to the furnace surfaces to react with a greater amount or higher concentration of the substance than is necessary thereafter for the slag layers remote from the surfaces, with respect to which layers only friability and not tenacity is of major significance. However, this is merely an hypothesis.

The amount of substance to be employed may vary substantially depending upon the precise composition of the black liquor and the precise nature of the particular furnace involved, and the amount of substance will also vary depending upon the amount of black liquor burned, since the more black liquor that is burned the greater is the tendency to form slag.

For a furnace burning approximately 100,000 pounds of black liquor solids per hour, the steady state application of substance after initial start-up should be between 10 and 200 pounds per hour of dry solids, with a range of 25-100 pounds per hour being preferred and with a rate of 50 pounds per hour having been found to be quite effective in one industrial installation.

The optimum practice of the present invention in one industrial application involves applying the substance initially at a higher rate. Thus the substance is first applied to the operative surfaces of a cleaned furnace, as by burning in that furnace a fuel other than black liquor, for a short period of time sufficient to coat the operative furnace surfaces with a layer of the substance, and then continuing to apply the substance after the burning of the black liquor is commenced, at a rate of 25-1000 pounds of dry solids per hour for a period of one to four hours, with a range of 100-300 pounds per hour for about two hours being preferred and with a rate of 200 pounds per hour for two hours giving excellent results. Thereafter the rate of application of the substance may be reduced either to the steady state value previously set forth or to an intermediate value of 20-400 pounds per hour for a period of 12-48 hours, with a preferred range of 50-200 pounds per hour for 24 hours, a rate of 100 pounds per hour for 24 hours giving excellent results.

As at present advised it is deemed preferable to inject the substance into the furnace substantially continuously as the burning of black liquor is carried out, but intermittent injection could also be employed provided that the intervals between injection were sufficiently short and the total amount of substance injected is sufficiently large to prevent the formation of any appreciable amounts of normally tough slag.

When the substance is thus injected into the furnace, and if the temperature of the boiler is varied at intervals, for example, every half hour, something which in any event often occurs in normal furnace operation as the throughput of the black liquor is varied, the slag deposits which form on the furnace surfaces will crack and fall off with normal sootblowing, so that, in effect, the practice of the present invention produces a self-deslagging effect which permits the furnace to be used substantially continuously, and without requiring any shut down for slag removal. The friability of the slag that forms when the substance is present, and its lack of tenaciousness to the boiler surfaces, together with the thermal stresses produced when temperature variations occur, causes the slag to separate itself from the furnace surfaces, somethin which does not happen in any known prior art operations.

Indeed, the practice of the present invention will result in much more efficient black liquor furnace operation, produce higher steam temperatures and greater steam production, more productive use of the steam produced because less of it need be used for boiler cleaning operations, and greater plant economy because of the virtual elimination of boiler down time for slag removal. In addition, the capacity of a given furnace to burn a given amount of black liquor will be increased.

Through the application of the substance to the black liquor furnace surfaces where slag tends to form substantially continuously during the time that the furnace is in operation, slag problems are greatly alleviated and the efficiency of operation of the furnace is greatly increased. Down time for slag removal is virtually eliminated, energy consumption is minimized, and the capacity of the furnace to burn black liquor is enhanced.

It will be understood that, if desired, other substances may be injected into the black liquor furnace along with or in addition to the substance which forms the subject of this invention, for whatever purposes those materials may serve, so long as they do not interfere with the slagimproving functions of the substance.

While but a limited number of embodiments of the present invention have been here specifically disclosed, it will be apparent that many variations could be made therein, all within the scope of this invention as defined in the following claims.

We claim:

1. The method of minimizing the problem of slag formation in a black liquor furnace which comprises applying to the furnace surfaces above the combustion zone where slag tends to form, substantially progressively as black liquor is burned in the furnace, a substance from the group consisting of sodium persulfate, manganese dioxide, cupric oxide, ferric oxide and mixtures thereof, said substance being introduced essentially solely into the system upstream of said surfaces at a location which permits it to reach said surfaces in essentially unreduced form, said substance then reacting at said surfaces with combustion products of the furnace to oxidize said products and be itself reduced.

2. The method of claim 1, in which said substance is applied substantially continuously as black liquor is burned.

3. The method of claim 1, in which said substance is applied substantially continuously as black liquor is burned, and in which said substance is applied in the form of finely divided particles.

4. The method of claim 1, in which said substance is applied substantially continuously as black liquor is burned, and in which said substance is applied over an extended period of time at a rate between 10 and 200 pounds of dry solids per hour for each 100,000 pounds per hour of black liquor solids burned.

5. The method of claim 1, in which said substance is applied substantially continuously as black liquor is burned, in which said substance is applied over an extended period of time at a rate between 10 and 200 pounds of dry solids per hour for each 100,000 pounds per hour of black liquor solids burned, and in which said substance is initially applied at the rate of about 20–1000 pounds of dry solids per hour for each 100,000 pounds per hour of black liquor solids burned for a period of from 1 to 4 hours.

6. The method of claim 1, in which said substance is applied substantially continuously as black liquor is burned, said substance is initially applied at the rate of about 20–1000 pounds of dry solids per hour for each 100,000 pounds per hour of black liquor solids burned for a period of from 1 to 4 hours, said substance is then applied at the rate of about 20–400 pounds of dry solids per hour for each 100,000 pounds per hour of black liquor solids burned for a period of about 12 to 48 hours, and in which said substance is then applied over an extended period of time at a rate between 10 and 200 pounds of dry solids per hour for each 100,000 pounds per hour of black liquor solids burned.

7. The method of claim 1, in which said substance is applied substantially continuously as black liquor is burned, said substance is initially applied at the rate of about 20–1000 pounds of dry solids per hour for each 100,000 pounds per hour of black liquor solids burned for a period of 1 to 4 hours, said substance is then applied at the rate of about 50–200 pounds of dry solids per hour for each 100,000 pounds per hour of black liquor solids burned for a period of about 24 hours, and in which said substance is then applied over an extended period of time at a rate between 10 and 200 pounds of dry solids per hour for each 100,000 pounds per hour of black liquor solids burned.

8. The method of claim 1, in which said substance is applied substantially continuously as black liquor is burned, said substance is initially applied at the rate of about 20–1000 pounds of dry solids per hour for each 100,000 pounds per hour of black liquor solids burned for a period of from 1 to 4 hours, said substance is then applied at the rate of about 100 pounds of dry solids per hour for each 100,000 pounds per hour of black liquor solids burned for a period of about 24 hours, and in which said substance is then applied over an extended period of time at a rate between 10 and 200 pounds of dry solids per hour for each 100,000 pounds per hour of black liquor solids burned.

9. The method of claim 1, in which said substance is applied substantially continuously as black liquor is burned, and in which said substance is applied over an extended period of time at a rate between 10 and 200 pounds of dry solids per hour for each 100,000 pounds per hour of black liquor solids burned, and in which said substance is initially applied at the rate of about 100 to 300 pounds of dry solids per hour for each 100,000 pounds per hour of black liquor solids burned for a period of two hours.

10. The method of claim 1, in which said substance is applied substantially continuously as black liquor is burned, said substance is initially applied at the rate of about 100–300 pounds of dry solids per hour for each 100,000 pounds per hour of black liquor solids burned for a period of two hours, said substance is then applied at the rate of about 50–200 pounds of dry solids per hour for each 100,000 pounds per hour of black liquor solids burned for a period of about 24 hours, and in which said substance is then applied over an extended period of time at a rate between 10 and 200 pounds of dry solids per hour for each 100,000 pounds per hour of black liquor solids burned.

11. The method of claim 1, in which said substance is applied substantially continuously as black liquor is burned, said substance is initially applied at the rate of about 100–300 pounds of dry solids per hour for each 100,000 pounds per hour of black liquor solids burned for a period of two hours, said substance is then applied at the rate of about 100 pounds of dry solids per hour for each 100,000 pounds per hour of black liquor solids burned for a period of about 24 hours, and in which said substance is then applied over an extended period of time at a rate between 10 and 200 pounds of dry solids per hour for each 100,000 pounds per hour of black liquor solids burned.

12. The method of claim 1, in which said substance is applied substantially continuously as black liquor is burned, and in which said substance is applied over an extended period of time at a rate between 10 and 200 pounds of dry solids per hour for each 100,000 pounds per hour of black liquor solids burned, and in which said substance is initially applied at the rate of about 200 pounds of dry solids per hour for each 100,000 pounds per hour of black liquor solids burned for a period of two hours.

13. The method of claim 1, in which said substance is applied substantially continuously as black liquor is burned, said substance is initially applied at the rate of about 200 pounds of dry solids per hour for each 100,000 pounds per hour of black liquor solids burned for a period of about two hours, said substance is then applied at the rate of about 100 pounds of dry solids per hour for each 100,000 pounds per hour of black liquor burned for a period of about 24 hours, and in which said substance is then applied over an extended period of time at a rate between 10 and 200 pounds of dry solids per hour for each 100,000 pounds per hour of black liquor solids burned.

14. The method of claim 1, in which the substance is additionally initially applied to said surfaces when said surfaces are substantially free of slag.

15. The method of claim 1, in which the substance is additionally initially applied to said surfaces when said surfaces are substantially free of slag, and in which said substance is applied in the form of finely divided particles.

16. The method of claim 1, in which the substance is additionally initially applied to said surfaces when said surfaces are substantially free of slag, and in which said substance is applied substantially continuously as black liquor is burned.

17. The method of claim 1, in which the substance is additionally initially applied to said surfaces when said surfaces are substantially free of slag, in which said substance is applied substantially continuously as black liquor is burned, and in which said substance is applied in the form of finely divided particles.

18. The method of claim 1, in which the substance is additionally initially applied to said surfaces when said surfaces are substantially free of slag, in which said substance is applied substantially continuously as black liquor is burned, and in which said substance is applied over an extended period of time at a rate between 10 and 200 pounds of dry solids per hour for each 100,000 pounds per hour of black liquor solids burned.

19. The method of claim 1, in which the substance is additionally initially applied to said surfaces when said surfaces are substantially free of slag, in which said substance is applied substantially continuously as black liquor is burned, in which said substance is applied over an extended period of time at a rate between 10 and 200 pounds of dry solids per hour for each 100,000 pounds per hour of black liquor solids burned, and in which said substance is initially applied at the rate of about 20–1000 pounds of dry solids per hour for each 100,000 pounds per hour of black liquor solids burned for a period of from 1 to 4 hours.

20. The method of claim 1, in which the substance is additionally initially applied to said surfaces when said surfaces are substantially free of slag, said substance is applied substantially continuously as black liquor is burned, said substance is initially applied at the rate of about 20–1000 pounds of dry solids per hour for each 100,000 pounds per hour of black liquor solids burned for a period of from 1 to 4 hours, said substance is then applied at the rate of about 20–400 pounds of dry solids per hour for each 100,000 pounds per hour of black liquor solids burned for a period of about 12 to 48 hours, and in which said substance is then applied over an extended period of time at a rate between 10 and 200 pounds of dry solids per hour for each 100,000 pounds per hour of black liquor solids burned.

21. The method of claim 1, in which the substance is additionally initially applied to said surfaces when said surfaces are substantially free of slag, said substance is applied substantially continuously as black liquor is burned, said substance is initially applied at the rate of 20–1000 pounds of dry solids per hour for each 100,000 pounds per hour of black liquor solids burned for a period of 1–4 hours, said substance is then applied at the rate of about 50–200 pounds of dry solids per hour for each 100,000 pounds per hour of black liquor solids burned for a period of about 24 hours, and in which said substance is then applied over an extended period of time at a rate between 10 and 200 pounds of dry solids per hour for each 100,000 pounds per hour of black liquor solids burned.

22. The method of claim 1, in which the substance is additionally initially applied to said surfaces when said surfaces are substantially free of slag, said substance is applied substantially continuously as black liquor is burned, said substance is initially applied at the rate of about 20–1000 pounds of dry solids per hour for each 100,000 pounds per hour of black liquor solids burned for a period of from 1 to 4 hours, said substance is then applied at the rate of about 100 pounds of dry solids per hour for each 100,000 pounds per hour of black liquor solids burned for a period of about 24 hours, and in which said substance is then applied over an extended period of time at a rate between 10 and 200 pounds of dry solids per hour for each 100,000 pounds per hour of black liquor solids burned.

23. The method of claim 1, in which the substance is additionally initially applied to said surfaces when said surfaces are substantially free of slag, in which said substance is applied substantially continuously as black liquor is burned, in which said substance is applied over an extended period of time at a rate between 10 and 200 pounds of dry solids per hour for each 100,000 pounds per hour of black liquor solids burned, and in which said substance is initially applied at the rate of about 100 to 300 pounds of dry solids per hour for each 100,000 pounds per hour of black liquor solids burned for a period of two hours.

24. The method of claim 1, in which the substance is additionally initially applied to said surfaces when said surfaces are substantially free of slag, said substance is applied substantially continuously as black liquor is burned, said substance is initially applied at the rate of about 100–300 pounds of dry solids per hour for each 100,000 pounds per hour of black liquor solids burned for a period of two hours, said substance is then applied at the rate of about 50–200 pounds of dry solids per hour for each 100,000 pounds per hour of black liquor solids burned for a period of about 24 hours, and in which said substance is then applied over an extended period of time at a rate between 10 and 200 pounds of dry solids per hour for each 100,000 pounds per hour of black liquor solids burned.

25. The method of claim 1, in which the substance is additionally initially applied to said surfaces when said surfaces are substantially free of slag, said substance is applied substantially continuously as black liquor is burned, said substance is initially applied at the rate of about 100–300 pounds of dry solids per hour for each 100,000 pounds per hour of black liquor solids burned for a period of two hours, said substance is then applied at the rate of about 100 pounds of dry solids per hour for each 100,000 pounds per hour of black liquor solids burned for a period of about 24 hours, and in which said substance is then applied over an extended period of time at a rate between 10 and 200 pounds of dry solids per hour for each 100,000 pounds per hour of black liquor solids burned.

26. The method of claim 1, in which the substance is additionally initially applied to said surfaces when said surfaces are substantially free of slag, in which said substance is applied substantially continuously as black liquor is burned, in which said substance is applied over an extended period of time at a rate between 10 and 200 pounds of dry solids per hour for each 100,000 pounds per hour of black liquor solids burned, and in which said substance is initially applied at the rate of about 200 pounds of dry solids per hour for each 100,000 pounds per hour of black liquor solids burned for a period of two hours.

27. The method of claim 1, in which the substance is additionally initially applied to said surfaces when said surfaces are substantially free of slag, said substance is applied substantially continuously as black liquor is burned, said substance is initially applied at the rate of about 200 pounds of dry solids per hour for each 100,000 pounds per hour of black liquor solids burned for a period of two hours, said substance is then applied at the rate of about 100 pounds of dry solids per hour for each 100,000 pounds per hour of black liquor solids burned for a period of about 24 hours, and in which said substance is then applied over an extended period of time at a rate between 10 and 200 pounds of dry solids per hour for each 100,000 pounds per hour of black liquor solids burned.

28. The method of claim 1, in which, during the operation of the furnace in burning black liquor, the surfaces to which the substance is applied are subjected to temperature variations effective to break up the slag which forms on said surfaces.

29. The method of claim 1, in which said substance is applied substantially continuously as black liquor is burned, and in which the substance is applied to said surfaces prior to as well as during the burning of black liquor in the furnace.

30. The method of claim 1, in which said substance is introduced into the system at a location where the temperature is relatively low.

* * * * *